US007754284B2

(12) United States Patent
Roy

(10) Patent No.: US 7,754,284 B2
(45) **Date of Patent: *Jul. 13, 2010**

(54) METHOD FOR TREATING LIGNOCELLULOSIC MATERIAL

(76) Inventor: Jacques Roy, 2389 Rue Maritain, Sillery, Quebec (CA) G1T 1N6

( * ) Notice: Subject to any disclaimer, the term of this patent is extended or adjusted under 35 U.S.C. 154(b) by 845 days.

This patent is subject to a terminal disclaimer.

(21) Appl. No.: 11/122,083

(22) Filed: May 5, 2005

(65) Prior Publication Data

US 2006/0013957 A1 Jan. 19, 2006

Related U.S. Application Data

(60) Provisional application No. 60/587,876, filed on Jul. 15, 2004.

(51) Int. Cl.
*B05D 3/02* (2006.01)

(52) U.S. Cl. ..... 427/254; 427/297; 427/317; 427/325; 427/351; 427/393; 427/397

(58) Field of Classification Search ..... None
See application file for complete search history.

(56) References Cited

U.S. PATENT DOCUMENTS 4,076,871 A * 2/1978 Short et al. ..... 427/397
4,548,839 A * 10/1985 Moldrup et al. ..... 427/345
5,024,861 A * 6/1991 Vinden et al. ..... 427/254
5,330,847 A * 7/1994 Murphy et al. ..... 428/537.1
6,374,513 B1 * 4/2002 Unternhahrer et al. ..... 34/396
6,399,109 B1 * 6/2002 Brite et al. ..... 424/660
6,426,118 B2 * 7/2002 Barnisin, Jr. ..... 427/297
6,821,631 B2 * 11/2004 Grantham et al. ..... 428/453
7,246,452 B1 * 7/2007 Roy ..... 34/396

FOREIGN PATENT DOCUMENTS

WO WO2004/113039 * 12/2004

OTHER PUBLICATIONS

Wood Preservation, The Ultimate New Zealand Forest Industry Resource, Forestryinsights, p. 2, last full paragraph entitled "Vapour Phase" at http://www.insights.co.nz/products_processes_wpre.aspx.

* cited by examiner

*Primary Examiner*—Timothy H Meeks
*Assistant Examiner*—Joseph Miller, Jr.
(74) *Attorney, Agent, or Firm*—Gowling Lafleur Henderson LLP

(57) ABSTRACT

A method for heat treating lignocellulosic material with a water-soluble preservative, such as preferably borate, involves the modification of the lignocellulosic material by heat to a moisture content of 0 to 5%, and preferably as close as possible to 0%. The thermo-treatment of the lignocellulosic material drives out not only free extra cellular water but also the intercellular and intracellular water. The process of modification by heat effectively kills the cells, permanently altering their cellular structure, and locking or fixing the preservative in the lignocellulosic material so that the water-soluble preservative does not leach out of the treated lignocellulosic material in the presence of rain water.

11 Claims, No Drawings

METHOD FOR TREATING LIGNOCELLULOSIC MATERIAL

CROSS-REFERENCE TO RELATED APPLICATIONS

This application claims the benefit of priority under 35 U.S.C. 119(e) from U.S. Provisional Patent Application Ser. No. 60/587,876 entitled METHOD FOR TREATING LIGNOCELLUSIC MATERIAL filed on Jul. 15, 2004.

TECHNICAL FIELD

The present invention relates to methods for treating wood and, more specifically, to methods for treating wood with borate or other water-soluble preservatives.

BACKGROUND OF THE INVENTION

Unprotected wood structures are susceptible to degradation by fungi and insects such as termites, which can cause substantial damage to wood building structures. Property damage in US alone is estimated to be in the neighborhood of 1 billion dollars a year. Various processes and chemicals have been used to treat wood to protect it from insect degradation. For example, preservatives, such as Copper Chrome Arsenate (CCA), ACC, ACQ and borate, have been impregnated in wood by a variety of processes. One popular method of integrating chemicals in the wood is by a vacuum/pressure treatment in the presence of an aqueous solution containing the preservative.

While the known methods are relatively successful at introducing preservatives in wood products, they necessitate the used of costly systems and may not be energy efficient. Accordingly improved methods are desirable. Also the resulting product is very prone to wash out by exposure to water. In particular, borate-treated lumber is particularly prone to leaching or wash-out by rain water and cannot be used in exterior structures. Methods have been developed that attempt to prevent the leaching out of preservatives. One such method is described in U.S. Pat. No. 6,426,118 to Barnisin. The method consists in drying the wood before infusing the preservative followed by further drying and the infusion of a waxy solid that constitutes a barrier to water and prevent leaching of the active ingredient. This method suffers from the need to treat the wood with not only the active ingredient but also the waxy solid which makes the treatment longer and more costly. Furthermore the wax may adversely affect further treatment of the wood with coatings such as paint.

There is thus a need for an improved process for treating wood whereby the impregnated water-soluble preservatives are inhibited from leaching out of the wood.

SUMMARY OF THE INVENTION

According to an aspect of the present invention green or dry wood can be treated with a preservative by placing the wood in an environment of aqueous vapor containing the preservative such as a salt soluble in water. In an embodiment of the invention heat is applied to the wood therefore favoring the penetration of the water soluble salt preservative in the wood. The extent of wood treatment can be achieved by controlling the concentration of the salt and the dryness of the wood. The invention provides also a method for treating wood which enhances fixation (or "locking" or "fixing") of the borate or other water-soluble preservatives in the wood. By locking or fixing the water-soluble preservative within the wood, the preservative is prevented from leaching out of the wood, which makes the wood particularly useful in outdoor applications where it is exposed to rain. Since the preservative is inhibited from leaching out of the wood when exposed to water, the wood is therefore substantially permanently protected from wood-destroying fungi and insects such as termites.

In general, the present invention provides a method whereby lignocellulosic material is treated with a preservative using aqueous vapor and water as a vector, the method involves as a second part the modification of the wood structure by heat, i.e. the extreme drying of wood to a moisture content of between 0 and 5%, and preferably as close to 0% as possible, such that the cellular structure of the wood is permanently altered, thereby locking or "fixing" the preservative (e.g. borate or other water-soluble preservative) in the cells of the wood. This treatment method can be performed on green wood or on dried wood but not on wood already modified by heat. All prior art methods of treating wood that are known to the Applicant involve drying the wood to a moisture content as low as 8-10%, but not any lower. This prior-art technique drives out free or extracellular water and even some intercellular water. The method in accordance with the present invention modifies the wood structure by drying it much further, to as low as 0% moisture content, which first drives out the remains of the intercellular water and then drives out the intracellular water. The modification of the wood structure by heat in this manner effectively altered the cells structure in the wood, permanently changing their cellular structure, and thus causing any preservative which has diffused into the wood to become locked or fixed within the wood. Accordingly, wood treated in this manner is highly resistant to outward diffusion and leaching out of the preservative from the wood.

The modification of the wood structure by heat for the purpose of fixing the water-soluble preservative in the wood can generally proceed in one of two methods: in a first method, a wood that is already preservative-treated is vapor-dried until the moisture content of the wood falls to within 0-5%, and preferably as close to 0% as possible. In a second method, the preservative can be dissolved and or introduced in an aqueous solution and vaporized (or sprayed) in a chamber containing the lignocellulosic material. Alternatively, an aqueous solution of the preservative can be pulverized in the aqueous vapor within the chamber to be mixed therewith. Untreated wood is vapor-dried in the presence of a preservative-laden vapor which infuses the preservative into the wood. The wood is vapor-dried until a moisture content of the wood is between 0 and 5%, and preferably as close to 0% as possible. With either method, the cellular structure of the wood is altered by the heat that locks the preservative in the wood in such a manner that it will not leach out in the presence of water. Without the modification of the wood structure by heat the wood will be treated but the salt will be subject to leaching.

It will be appreciated that in the treating part the aqueous solution/vapor may comprise other solvents than water to help the penetration of the salt into the wood.

The vapor can be used to dry the lignocellulosic material either after or during the treatment with the preservative. In the respect it may be advantageous to control the temperature within the chamber so as to maximize the penetration of the preservative and the drying of the material. For example, temperatures of between 15° C. and 60° C. may be used to treat the material with the preservative and temperatures between 60° C. and 120° C. can be used for drying the material. The time of exposure to appropriate temperature for penetration of the preservative and drying of the material may depend on the wood species and the desired degree of penetration and dryness. The lignocellulosic material may also be treated without having been subjected to drying condition (i.e. the material can be treated green). For the modification of the wood structure by heat the material is heated to a temperature typically comprised between 180° C. and 240° C.

After the modification of the wood structure by heat, the wood may reabsorb some of ambient moisture, and accordingly wood modified by heat ("thermo-modified") may ultimately have moisture content between 3% and 5%. Even if the moisture content, after the modification by heat, rises toward 5%, the process of modification of the wood structure by heat has permanently altered the cellular structure of the wood and therefore the preservative is already permanently locked or fixed in the wood, thus preventing leaching out of the preservative. Re-humidification of the wood treated by modification of the wood structure by heat does not lead to leaching, unlike the prior-art drying methods which are susceptible to diffusion due to re-absorption of water in the wood.

Further features and advantages of the present invention will become apparent from the following detailed description.

DETAILED DESCRIPTION OF THE PREFERRED EMBODIMENTS

The present invention provides a method of treating lignocellulosic material, such as wood, with a water-soluble preservative, such as preferably borate; the treatment do not required the use of vacuum/pressure treatment. The present invention provides a method whereby the lignocellulosic material is treated using aqueous vapor and water as a vector and then the modification of the wood structure by heat (thermo-modified) locks or fixes the preservative in the wood. Thermo-modifying the wood to extremely low moisture content, i.e. between 0 and 5%, and preferably as close to 0% as possible, not only drives out the free or extracellular water but also the intercellular and intracellular water. In so doing, the process of thermo-modifying permanently alters the cellular structure of the wood, effectively killing the cells, and thus locking or fixing the preservative in the wood. The preservative, once locked by the process of modification of the wood structure by heat, is highly resistant to leaching out, even in the presence of water. Woods preserved with borate and thermo-modified in like manner are highly useful in building outdoor structures exposed to rain and humidity as the preservative does not leach out and therefore the wood does not become vulnerable to attack from fungi or termites.

In one preferred embodiment of the invention the wood is first treated with a wood preservative to produce wood having a desired concentration of preservative. The wood is then vapor-dried to extremely low moisture content, e.g. close to 0%. This process of modification of the wood structure by heat changes the cellular structure of the wood and thus locks or fixes the preservative in the wood.

In another preferred embodiment, untreated wood is vapor-dried with a given concentration of borate in the vapor. The preservative can be dissolved and or introduced in an aqueous solution and vaporized (or sprayed) in a chamber containing the lignocellulosic material. Alternatively, an aqueous solution of the preservative can be pulverized in the aqueous vapor within the chamber to be mixed therewith. The borate-laden vapor treats and dries the wood, and the modification of the wood structure by heat (increased of the heat) causing the borate to become locked inside the wood by this process of thermo-treated wood.

In another embodiment, untreated wood can be dried to about 8-19% maximum moisture content to drive out all free water (and perhaps some of the intercellular water) and then wood can be treated by vapor-drying it in the presence of a vaporized water-soluble preservative.

In order to accelerate the penetration of borate into the wood, ethylene glycol or other such penetration accelerants can be added to the vapor. Ethylene glycol will enhance the rate of penetration and thus reduce the time required for the treatment process.

Treatment of the wood with a preservative can be accomplished using processes known in the art, such as but not limited to vacuum/pressure treatment.

For greater clarity, the preservative-treated wood is dried to a moisture content below that which is necessary to support diffusion of the preservative within the wood. In general, simple removal of "free" (extra-cellular) water is not sufficient to achieve this goal. One must also remove the intercellular water and finally the intra-cellular water in order to alter the cellular structure of the wood. At the end of the drying process, the overall moisture content of the preservative-treated wood should be less than 8-19% to avoid diffusion and, more preferably, between about 0 and 5%, to avoid leaching and thus locks or fixes the preservative into the wood, which will of course depend on the species of the wood being treated.

The method is particularly useful for anhydride and/or salt-based preservatives or any preservatives that would be susceptible to leaching out of the wood as a result of the presence of water. In a preferred embodiment borate is used at concentrations sufficient to destroy or prevent the growth of certain wood-destroying fungi and insects such as termites and beetles. In a preferred embodiment final concentrations of between 2 and 5 $kg/m^3$ and more preferably, between 2.7 and 4.5 $kg/m^3$ are used. Various forms of borate can be used, such as borate salts which may include but are not limited to disodium octaborate tetrahydrate.

The drying and/or the thermo-modification of the preservative-treated wood to reduce the moisture content below the level necessary to support diffusion and/or to avoid leaching and thus locks or fixes the preservative into the wood, may be achieved using various known drying and/or the thermo-modifying methods. These methods may comprise, for example, steps in which the wood is dried using water vapor as a heat conductor and thermo-treated in an oxygen-depleted environment (for example, by replacing oxygen with another gas such as nitrogen).

In a further embodiment, it will be appreciated that the wood may be treated during the drying process. For example, the preservative may be incorporated in the water vapor utilized to heat the wood. The heating process may also be coupled with known processes for incorporating preservatives in wood such as but not limited to vacuum/pressure treatment. The coupling may be accomplishing in such way that the drying and preservative incorporation take place substantially simultaneously.

It will also be appreciated that treatment with the preservative may take place at some intermediate step of the drying process. For example, the wood may be dried until a certain desired level of moisture is reached at which point the preservative may be incorporated in the wood prior to resuming the drying process.

In a preferred embodiment, the invention is carried out using the time-temperature profile described in U.S. Pat. No. 6,374,513, which is hereby incorporated by reference.

Treatment using borate preservative can also confer fire-retardant properties to the treated wood.

In another embodiment of the invention there is also provided compositions comprising wood and one or more preservative and in which the moisture content is below the level supporting diffusion and/or to avoid leaching and thus locks or fixes the preservative into the wood such as can be obtained using the method described above. The wood included in the composition may consist of but is not limited to structural wood, laminated wood, fibre wood panels, plywood and the like.

In view of the foregoing, it should be understood that the treatment of wood with borate or other water-soluble preservatives can be done in different ways. As borate is the preferred preservative, the process has been described with respect to borate, although it should be understood that other preservatives can be substituted.

The embodiments of the invention described above are intended to be exemplary only and should not be construed as delimiting the scope of the invention. The scope of the invention is defined solely by the appended claims.

I claim:

1. A method of treating lignocellulosic material, the method comprising:

providing a heat-treatment chamber that is adapted only for one or both of atmospheric drying and atmospheric heat treating, the heat-treatment chamber being adapted for circulation of air and gases within the heat-treatment chamber and for extraction of gases and moisture from the heat-treatment chamber;

placing lignocellulosic material in the heat-treatment chamber; and treating the lignocellulosic material in only the heat-treatment chamber by exposing the lignocellulosic material to an aqueous vapor containing a water-soluble preservative while simultaneously drying the lignocellulosic material by heating the lignocellulosic material in the chamber and extracting moisture and gases from the heat-treatment chamber, wherein the treating and drying is performed entirely at atmospheric pressure.

2. The method as claimed in claim 1 wherein the lignocellulosic material is dried until a moisture content of the lignocellulosic material is between 0 and 5%.

3. The method as claimed in claim 2 wherein the lignocellulosic material is dried until a moisture content of the lignocellulosic material is less than 1%.

4. The method as claimed in claim 1 wherein the water-soluble preservative comprises borate.

5. The method as claimed in claim 4 wherein the water-soluble borate preservative comprises disodium octaborate tetrahydrate.

6. The method as claimed in claim 4 wherein a final concentration of borate is between 2 and 5 $kg/m^3$.

7. The method as claimed in claim 1 wherein the lignocellulosic material is untreated wood.

8. The method as claimed in claim 1 wherein the lignocellulosic material is green wood.

9. A method of treating lignocellulosic material, the method comprising:

providing a heat-treatment chamber that is adapted only for one or both of atmospheric drying and atmospheric heat treating;

placing untreated lignocellulosic material in the heat-treatment chamber; and treating the lignocellulosic material in only the heat-treatment chamber by exposing the lignocellulosic material to an aqueous vapor containing a water-soluble preservative while simultaneously drying the lignocellulosic material by heating the lignocellulosic material in the heat-treatment chamber wherein the treating and drying occur entirely at atmospheric pressure.

10. The method as claimed in claim 9 wherein the lignocellulosic material is green wood.

11. The method as claimed in claim 9 wherein the water-soluble preservative is borate.

* * * * *